United States Patent [19]

Masuda et al.

[11] 4,159,608

[45] Jul. 3, 1979

[54] BOTTLING MACHINE

[75] Inventors: Sinzo Masuda, Shimizu; Tsuneyuki Okochi, Shizuoka, both of Japan

[73] Assignee: Package Engineering Corporation, Shizuoka, Japan

[21] Appl. No.: 901,172

[22] Filed: Apr. 28, 1978

[51] Int. Cl.[2] ..... B65B 3/04; B65B 7/28; B67B 1/04; B67B 5/06

[52] U.S. Cl. ..... 53/282; 141/179; 141/279; 141/284

[58] Field of Search ..... 53/282, 266, 272, 276, 53/273; 141/178, 179, 136, 284, 279

[56] References Cited

U.S. PATENT DOCUMENTS

| | | | |
|---|---|---|---|
| 3,152,622 | 10/1964 | Rothermel | 141/179 X |
| 3,572,007 | 3/1971 | Shelby et al. | 53/282 |
| 3,775,934 | 12/1973 | Smith | 53/282 X |
| 4,004,620 | 1/1977 | Rosen | 141/179 X |

*Primary Examiner*—Horace M. Culver
*Attorney, Agent, or Firm*—Fulbright & Jaworski

[57] ABSTRACT

A bottling machine wherein a nozzle holder having a plurality of charging nozzles is installed in rotatable and vertically movable fashion above a round table devised to hold a plurality of bottles on the periphery thereof and be capable of rotating intermittently, a member for elevating said nozzle holder and a member for biasing it to rotate opposite to the direction of rotation of said round table are provided, and said nozzle holder and round table are equipped with an engagement member so that they should be engaged with or disengaged from each other when the holder descends or ascends, whereby when the nozzle holder descends and rotates together with the table, the charging of the bottles is performed by means of the nozzles, and upon completion of the charging, the foregoing working member elevates the nozzle holder.

4 Claims, 2 Drawing Figures

BOTTLING MACHINE

BACKGROUND OF THE INVENTION

The present invention relates to an improvement on bottling machines, particularly a bottling machine of index table type which is designed to charge a liquid in a multiplicity of bottles held on the periphery of a table rotating intermittently.

According to the conventional bottling machines of this kind, the charging has been performed by means of a single charging nozzle and therefore it has been infeasible to assign a sufficient time for the charging. With a view to making up for this drawback in the prior art, there has been proposed a bottling machine equipped with a plurality of nozzles. To explain the way of charging bottles by means of these nozzles in the case of, for instance, a bottling machine equipped with six nozzles, said six nozzles designed to move vertically are disposed above a table designed to move intermittently by 1 pitch at a time, a liquid is charged in the bottles by 1/6 of the capacity thereof through these nozzles with every stop of the rotary table in the intermittent movement thereof, and the charging is completed at the sixth stop with 5-pitch movement. And, during this intermittent operation, the charging nozzle is put in and pulled out from the bottles as often as the liquid is charged. Therefore, in the case where the intermittent movement cycle of the table is set at 1 second, the time for movement is set at 0.5 second and the time for ascent of nozzle is set at 0.2 second, the effective charging time is no more than 0.3 sec.$\times 6 = 1.8$ second.

Because of the effective charging time being as short as 1.8 second, charging of a large quantity of liquid in a big bottle becomes infeasible. The only way to eliminate such an inconvenience is to increase the number of nozzles or to prolong the charging time 1.8 second. In the former case, however, the bottling machine comes to be of complex design and expensive, while in the latter case, the speed of vertical movement of the nozzle and the speed of movement of the bottle must be increased, entailing such drawbacks that the liquid spills outside the bottle or overflows the neck of bottle.

SUMMARY OF THE INVENTION

Principal object of the present invention is to eliminate the foregoing drawbacks of the conventional bottling machines and to provide a bottling machine which is devised such that a nozzle holder having a plurality of nozzles is made to rotate together with a rotary table for a prescribed time while continuously charging a liquid in the bottles held on the table, thereby preventing the liquid from spilling outside the bottles, lengthening the effective charging time so as not to impede the charging of big bottles and improving the movement cycle of the rotary table so as to perform the bottling work efficiently.

Another object of the present invention is to provide a bottling machine which is devised such that a nozzle holder is installed to be capable of rotation and vertical movement, said nozzle holder is vertically movable with the aid of a working member and is always rotatable in a direction opposite to the direction of rotation of the table with the aid of a biasing member, the nozzle holder and the table disengage from each other when the former ascends relative to the latter and engage with each other when the former descends relative to the latter, the nozzle holder rotates together with the table in the same direction when it descends and, during thus rotating, a plurality of nozzles held on the holder perform the charging of the liquid in a plurality of bottles held on the table and stops the charging of the liquid with the ascent of the nozzle holder thereafter, whereby it is rendered possible to charge a uniform quantity of liquid in each bottle automatically and efficiently.

A further object of the present invention is to provide a bottling machine which is devised such that the engagement member on the rotary table comprises plural holes provided on the points of intersection of plural straight lines extending radially at a prescribed center-angle to the center of the bottle holding section from the center of the table and a circumference of an optional radius, the number of said holes being the quotient obtained by dividing the number of pockets for bottles provided on the circumference by the number of charging nozzles, the engagement member on said nozzle holder comprises rods which are perpendicularly installed on the bottom face of the nozzle holder and are supposed to fit in the foregoing holes, and these two engagement members can engage with certainty despite the simple structure thereof whereby the nozzle holder can be surely rotated synchronously with the table and an exact bottling can be performed.

A still further object of the present invention is to provide a bottling machine which employs an air cylinder in elevating said nozzle holder, and ensures an exact bottling despite the simplicity of operation thereof.

DETAILED DESCRIPTION OF THE INVENTION

Figure 1:
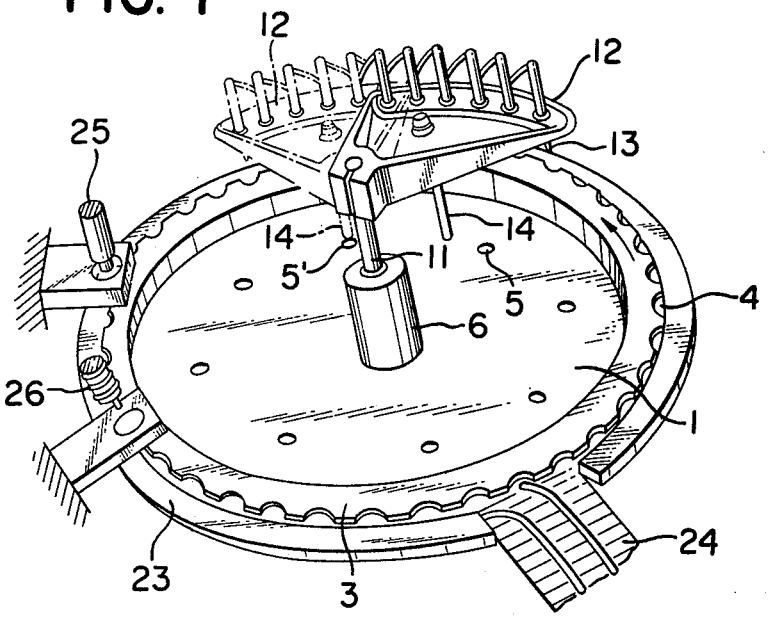
FIG. 1 is a perspective view of the essential part of an example embodying the bottling machine according to the present invention.

Referring to the appended drawings, the reference numeral 1 denotes the rotary table, and an annular side wall 2 is installed near the periphery thereof. The top wall 3 stretches out horizontally from the top of the side wall 2, and on the brim of this top wall 3 are provided the pockets 4 arranged at intervals equivalent to 1-pitch feed of the table 1 so as to engage with the bottle A. In the table 1 are bored plural holes 5, 5' disposed on the points of intersection of plural straight lines extending radially at a prescribed center-angle to the center of the notch 4 from the center of the table 1 and a circumference of an optional radius, the number of said holes 5, 5' being the quotient obtained by dividing the number of pockets which will be explained later on by the number of charging nozzles.

In the center of the table 1 is provided a sleeve 6, said sleeve 6 being rotatably supported on an internal sleeve 8 with the aid of bearings 7. On the sleeve 6 is provided a gear 9 disposed beneath the back of the table 1.

The sleeve 8 is installed on a frame 10, and in the inside thereof is supported a shaft 11 to be rotatable and vertically movable with the aid of bearings. On the upper end of the shaft 11 is fixed a fan-shaped nozzle holder 12, and near the brim of this nozzle holder 12 are held plural number of nozzle 13 (in the drawings, 6 nozzles). The back of the nozzle holder 12 is provided with a perpendicularly installed rod 14 which is disposed confronting the holes 5 and 5' so as to fit therein.

In the frame 10 is installed an intermittent driving member 15, and on the upper end of a driving shaft 16 thereof is installed a pinion 17, said pinion 17 being engaged with the aforesaid gear 9. In the frame 10 is further installed a post 18, and between this post 18 and an arm 19 provided on the aforesaid shaft 11 is stretched a spring 20. In the frame 10 is still further installed an air cylinder 21, and on the upper end of the piston rod 22 of this air cylinder 21 is supported the lower end of the shaft 11.

In FIG. 1, the reference numeral 23 denotes an annular holder installed on the circumference of the table 1. A portion of this holder is cut off so as to install therein a carry-in/carry-out member 24 for bottles. 25 denotes a corking machine for applying the inner stopper, and 26 denotes a binding machine for applying the outer stopper.

The mode of operation of the above described bottling machine will be explained in the following.

Figure 2:
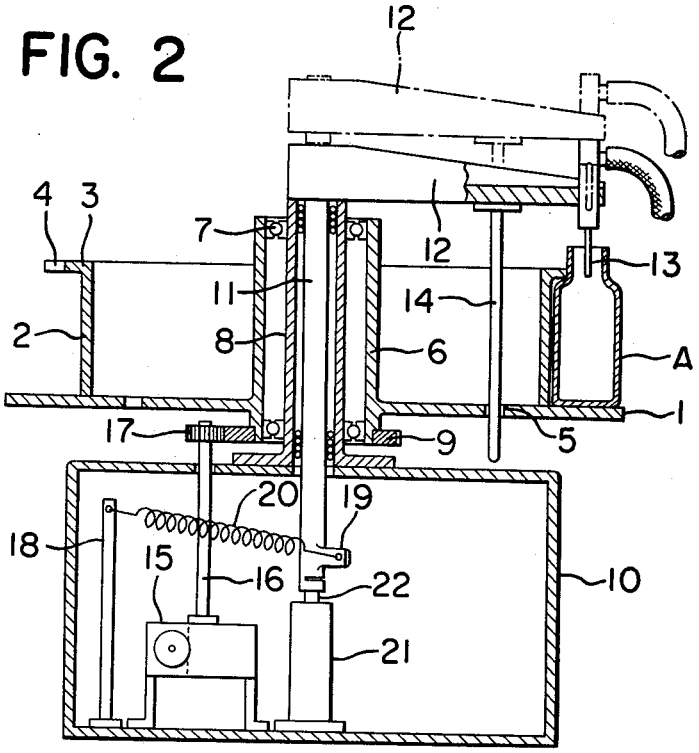
FIG. 2 is a front view of the longitudinal section of the same machine as in FIG. 1.

To begin with, when the air cylinder 21 is actuated and the shaft 11 is elevated to a position shown by a dotted line in FIG. 2, the rod 14 disengages from the hole 5, the shaft 11 is pulled by the spring 20, the nozzle holder 12 is moved to this side in FIG. 2, and the working of the air cylinder 21 stops thereat. At this, the holder 12 descends by virtue of dead load thereof, and rotates until the rod 14 arrives at the starting position on the table 1 such as shown by a solid line in FIG. 1 and comes to a halt there.

Then, the table 1 is intermittently moved in the direction of arrow in FIG. 1 by the intermittent driving member 15 with the aid of gears 17 and 9, and when the hole 5 moves to beneath the rod 14 as a result of this movement, the rod 14 fits in the hole 5 by virtue of dead load of the holder 12, the holder 12 descends to a position shown by a solid line in FIG. 2, and as a result of this descent six nozzles 13 are inserted in six bottles A.

Thereafter, by dint of engagement of the rod 14 and the hole 5, the holder 12 moves in defiance of the force of the spring 20 together with the table 1 and in the same direction as the table 1 by 5 pitches, to wit, up to the terminal position where the hole 5 becomes the hole 5' in FIG. 1 as shown by a dotted line. And, during the period of this movement, charging in the bottles A by the nozzles 13 is performed.

Subsequently, when the holder 12 arrives at the foregoing terminal position, a sensor not shown in the drawings senses this arrival, actuates the cylinder 21 and elevates the holder 12 again to a position shown by a dotted line in FIG. 2, and the holder 12 is pulled by the spring 20 to return to a position shown by a solid line in FIG. 1. On this occasion, the charging through the nozzle 13 is suspended. During the return process, the table 1 advances by 1 pitch.

By repeating the foregoing mode of procedure thereafter, the bottling work is carried out.

Inasmuch as the charging is performed in such a way as described above, even if 1 cycle is needed to return the fan-shaped charging head, since the charging is conducted continuously during the intermittent movement by 5 pitches and the intermittent movement cycle is 1 second as set forth above, the effective charging time will become 5 seconds.

Therefore, compared with the conventional bottling machine making an intermittent movement at the same cycle of 1 second and equipped with 6 charging heads wherein the charging time has been no more than 1.8 second, in the bottling machine according to the present invention, the charging time is 5 seconds, that is, 3.2 seconds longer. Consequently, it renders it possible to fill a larger bottle during the same period of time, and in the case where the bottle is of the same size, the cycle of the intermittent movement can be shortened.

What is claimed is:

1. A bottling machine comprising a round table which is equipped with bottle-holding pockets disposed on the periphery thereof and is intermittently rotatable, a liquid charging mechanism, and a mechanism for corking or applying a cap-bond on the neck of a bottle, wherein a nozzle holder equipped with a plurality of charging nozzles and capable of rotation and vertical movement is disposed above said table, a working member for elevating said nozzle holder, a member for always biasing said nozzle holder so as to rotate opposite to the direction of rotation of said table, and engagement members provided on said nozzle holder and table which engage with each other when the nozzle holder descends and disengages from each other when the holder ascends, whereby at the time when the nozzle holder descends and rotates together with the table, the charging in the bottles is performed by the nozzles, and after completion of the charging, the foregoing working member elevates the nozzle holder to allow it to return to its original position.

2. A bottling machine according to claim 1, wherein said nozzle holder is of a fan-shape and on an arc-shaped brim of the nozzle holder are disposed a plurality of nozzles, and the center of rotation of the nozzle holder is the same as that of said table.

3. A bottling machine according to claim 2, wherein the engagement member on said table comprises a plural number of holes which are disposed on the points of intersection of plural straight lines extending radially at a prescribed angle from each other toward the center of a predetermined group of bottle holding pockets from the center of the table, and a circumference of a predetermined radius, the number of said holes being the quotient obtained by dividing the number of said bottle-holding pockets by the number of charging nozzles, and the engagement member on said nozzle holder comprises a rod which is perpendicularly installed on the bottom face of the nozzle holder and are arranged to fit in the foregoing holes.

4. A bottling machine according to claim 2, wherein the working member for elevating said nozzle holder comprises an air cylinder.

* * * * *